United States Patent [19]

Kobale et al.

[11] 4,340,838

[45] Jul. 20, 1982

[54] CONTROL PLATE FOR A GAS DISCHARGE DISPLAY DEVICE

[75] Inventors: Manfred Kobale, Faistenhaar; Burkhard Littwin, Hohenschaeftlarn; Rolf Wengert, Munich, all of Fed. Rep. of Germany

[73] Assignee: Siemens Aktiengesellschaft, Berlin & Munich, Fed. Rep. of Germany

[21] Appl. No.: 149,915

[22] Filed: May 15, 1980

[30] Foreign Application Priority Data

Jul. 31, 1979 [DE] Fed. Rep. of Germany ..... 2931077

[51] Int. Cl.[3] ..... H01J 1/46

[52] U.S. Cl. ..... 313/348; 313/410; 313/105 CM; 313/217

[58] Field of Search ..... 313/188, 191, 196, 217, 313/410, 422, 494, 491, 105 CM, 348; 361/397; 333/1, 236

[56] References Cited

U.S. PATENT DOCUMENTS

| | | | |
|---|---|---|---|
| 3,619,700 | 11/1971 | Kupsky | 313/217 |
| 3,634,714 | 1/1972 | Anderson et al. | 313/494 X |
| 3,956,667 | 5/1976 | Veith | 313/398 |
| 4,066,929 | 1/1978 | Okamoto et al. | 313/217 X |
| 4,112,329 | 9/1978 | Veith | 313/491 |

FOREIGN PATENT DOCUMENTS

| | | |
|---|---|---|
| 2604104 | 3/1976 | Fed. Rep. of Germany . |
| 2742555 | 3/1978 | Fed. Rep. of Germany . |

*Primary Examiner*—Paul L. Gensler

*Attorney, Agent, or Firm*—Hill, Van Santen, Steadman, Chiara & Simpson

[57] ABSTRACT

A control plate for a gas discharge display device has a mechanically stable carrier plate of an electrically insulating material which has metallized column conductor tracks on one side and metallized row conductor tracks on an opposite side which in combination form a matrix of perpendicular rows and columns. The carrier plate has perforations extending through plate at points of intersection of the rows and columns. Each row and column is separately energizeable for selected transfer of electrons in the display device from one side of the plate to the other. The metallized tracks on each side extend a distance into the perforations so as to prevent charge accumulation within the perforations which would otherwise impair the control obtainable by the plate. The metallized portions of the perforations are separated by a ring of exposed carrier plate which is substantially nonconducting having a resistance of 100 megaohms or greater.

6 Claims, 5 Drawing Figures

CONTROL PLATE FOR A GAS DISCHARGE DISPLAY DEVICE

BACKGROUND OF THE INVENTION

1. Field of the Invention

The present invention relates to a control plate for use in a gas discharge display device having a matrix formed of perpendicular row and column conductor tracks on opposite sides of the plate with perforations through the plate at points of intersection of the rows and columns, and in particular to such a control plate wherein the metallization of the row and columns extends a distance into the perforations to prevent accumulation of charge therein.

2. Description of the Prior Art

Control plates for gas discharge display devices which essentially divide the interior of the display device into two portions are known in the art which have metallized row conductor tracks on one side and metallized column conductor tracks on the other side. The conductor and column tracks are disposed perpendicularly with respect to each other and in combination form a matrix having perforations through the control plate at the points of intersection of the row and column tracks. By selectively energizing a row conductor track and a column conductor track, the control perforation at the point of intersection of the energized row and column is thus also energized. Electrons in the plasma of the gas discharge space lying behind the control plate are thereby attracted into the acceleration space disposed in front of the control plate and are accelerated in this space onto the anode. An image point of light corresponding to the selected point of intersection of the matrix thereby arises at the point of incidence of the electron on a luminescent screen situated in front of the anode. Characters and images can be displayed on the luminescent screen by the utilization of an appropriate matrix drive circuit which controls the sequence and strength of the images. Such a display device functions according to the general principles of spacial separation of electron generation and electron acceleration, the so called double chamber principle, and is known, for example, from German OS No. 24 12 869 corresponding to U.S. Pat. No. 3,956,662 as well as German OS No. 26 15 721, corresponding to U.S. Pat. No. 4,112,329, the teachings of which are incorporated herein by reference.

As described above, the control plate in devices of the type found in the prior art consists of a carrier plate comprised of electrically insulating material such as, for example, glass, with metallized electrode tracks deposited on the opposite sides of the plate. In the conventional manufacture of such control plates, the perforation structure required for the electron passage through the plate is not etched into the glass until after the application of the track conductors on the front and rear sides of the plate perpendicular to each other. In order to achieve a high resolution of the image to be displayed on the luminescent screen, a very fine grid pattern is required consisting of the row and column conductors. The perforation structure which operates in combination with the grid structure can be etched in the carrier plate only if the carrier plate is comprised of a very thin glass plate as a result of etching technology limitations known to those skilled in the art. Such a thin glass plate has low mechanical stability and is subject to fracture which of course requires replacement of the plate before operation of the gas discharge device can resume, and in some cases in which the plate cannot be replaced renders the entire device useless.

This problem has resulted in the utilization of thicker carrier plates which thereby requires a different technology for generating the perforation structure therein. Conventional methods of perforating the thicker carrier plates utilize electron beam or laser boring which is directed at a carrier plate which is already metallized on both sides. This results, however, in the creation of control holes which have no metallization on their respective walls so that during operation charge accumulates on the hole walls which impairs the control afforded by the control plate by preventing or limiting the passage of other charge carriers through the holes.

SUMMARY OF THE INVENTION

It is an object of the present invention to provide a control plate for a gas discharge display device which exhibits a high degree of mechanical stability and has row and column conductors of high geometrical resolution thereon which are electrically separated from one another and which prevents accumulation of charge within the perforations occurring at the row and column intersections.

This object is inventively achieved in a control plate consisting of insulating material in which the metallized tracks on the opposite sides extend into the control perforations up to a defined depth such that perforations lying in a row on one side of the plate are electrically connected and perforations lying in a column on an opposite side of the plate are electrically connected, yet the column and row conductors are separated from one another within the perforations by a gap exposing the insulating material comprising the plate forming a ring of high resistance in excess of 100 megaohms. Depending upon separation requirements, the resistance between the metallized portions of the interiors of the perforations can be controlled so that the rows and columns are substantially completely separated. The metallization within the perforations will thus be energized along with the associated row and columns thereby preventing accumulation of charge within the perforation and allowing the full control capabilities of the plate to be utilized. This method allows a control plate structure to be formed on a carrier plate of insulating material such as glass or ceramic which has a thickness in the range of 0.3 to 2 mm.

In one embodiment of the invention, the metallized portions of the row and column conductors which extend into the perforations extend approximately equal depths therein from opposite sides of the plate. In another embodiment, the metallization from the column side extends substantially over the entire wall of each perforation and the metallization from the row side of the plate extends only slightly into the perforation.

This structure is manufactured by a method in which a glass or ceramic or other insulating material plate, which may be flat or slightly concave, is perforated by any manner such that a perforation grid of suitably high resolution for the control of electric charge carriers is formed. The perforation grid may be of any pattern and the perforations may be of any size within the limitations known to those skilled in the art, however, suitable resolution of the image to be produced generally requires that the number of perforations per square centimeter exceed 100. The insulating material plate has a thickness so as to provide a high degree of mechanical stability.

The stable perforated carrier plate is metallized over its entire surface on both sides with through plating into the perforations being allowed to occur to an extent such that electrical contact of the two metallized sides does not occur, that is, a ring of nonelectrically conducting area is allowed to remain which has a resistance in excess of 100 megaohms. The metallization may ensue, for example, by means of vaporization with a copper layer of approximately 300 nm, with the utilization of aluminum oxide or titanium applied in a layer of approximately 20 nm serving as an adhesive layer, for example. In cases in which particularly high adhesion is desired, the substrate may be heated to above 130° C. and/or a glow discharge may be undertaken. Both sides of the plate are vapor-deposited at an oblique angle while the substrate is rotated around an axis perpendicular to the substrate surface so that the required electrical separation properties can be achieved within the perforations of the carrier plate.

The metallization may also take place in such a manner that the opposite sides of the carrier plate are electrically connected, with separation within the control perforations subsequently being undertaken. This can be achieved in a method wherein after metallization of the carrier plate on both sides, both metal surfaces are coated with photoresist. The photoresist may be applied by any manner known to those skilled in the art such as spraying, roller coating or application of sheets and it is of no consequence whether the photoresist extends into the perforations or not. Although most manufacturers make use of positive photoresist, that is, photoresist which is soluble upon exposure to radiation, which is sprayed onto the carrier, however, the use of negative photoresist is within the inventive concept disclosed herein.

For generation of the conductor track structure on each side of the plate, a line grid is exposed by a photolithographic masking technique known to those skilled in the art on each side of the plate, with the grids being perpendicular with respect to each other. The line structure may be either selected such that the widths of the tracks correspond to the diameters of the perforations in which case it is necessary to achieve precise alignment of the grid and the perforations, or is selected such that the conductor tracks are of significantly finer width than the diameters of the perforations so that precise alignment of the line grid and the perforations is not necessary. Upon exposure, diffuse light will always enter the perforations and any positive photoresist which may be situated within the perforations is thereby dissolved. If a method of applying the photoresist is utilized which results in depositing some photoresist within the perforations, only positive photoresist may be utilized. If a photoresist foil is applied only to the surfaces of the carrier plate, either positive or negative photoresist may be utilized. By the utilization of the fine line grid pattern, the outlay necessary for precision alignment tools is significantly minimized. In any case, dimensioning of the track grid is undertaken such that no two perforation rows are electrically connected yet all perforations in a single row are electrically connected. This is equally true for the column side of the plate.

The metallic surfaces on each side of the plate from which the developed photoresist has been removed are strengthened to a thickness of a few micrometers such as, for example, by galvanic methods utilizing copper and/or nickel. The strengthening also extends, albeit with a reduced thickness, into the perforations. Thus conductor tracks are generated which are still connected to one another by means of the thin metallic layer which is still covered with the photoresist material. After removal of this remaining photoresist and etching away of the thin metal layer, conductor tracks remain on both sides of the plate which are electrically separated from one another and are respectively through-plated via the control perforations. The tracks extending beyond the perforated surface of the carrier plate can be electrically contacted and controlled in an appropriate manner to operate the display device.

The control plate as described above has the significant advantage that a mechanically stable carrier plate having an increased thickness can be utilized yet due to the metallization within the perforations, the accumulation of charge within the perforations is avoided or minimized so that the control properties of the plate are not impaired. Moreover, passage of the plasma charge carriers through the control perforations is more greatly facilitated by the absence of accumulated charge on the perforation walls.

DESCRIPTION OF THE PREFERRED EMBODIMENTS

Figure 1:
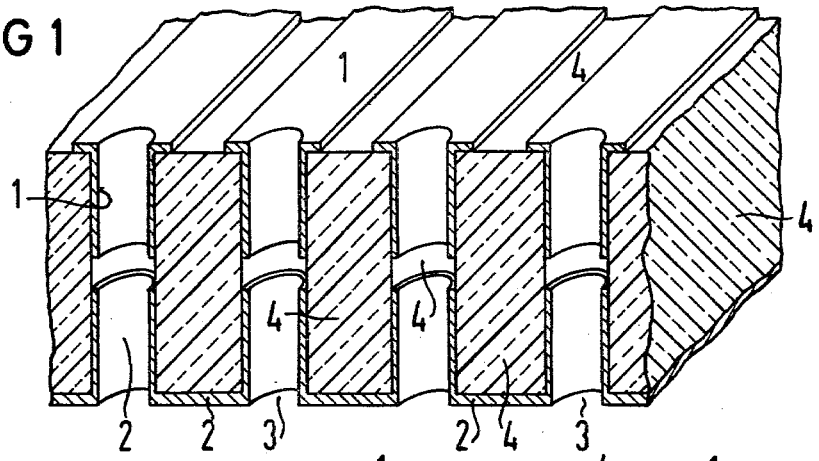
FIG. 1 is a perspective sectional view of a portion of a control plate having partially through-plated perforations constructed in accordance with the principles of the present invention.

A portion of a control plate utilizeable in a gas discharge display device is shown in FIG. 1 consisting of a carrier plate 4 comprised of electrically insulating material such as photosensitive glass or ceramic which has a number of perforations 3 extending therethrough which form control holes for selectively admitting plasma from one side of the plate to the other. The carrier plate 4 has a plurality of parallel column conductors 1 carried on one side thereof and a plurality of parallel row conductors 2 carried on the opposite side thereof, disposed perpendicularly with respect to the column conductors 1. The column conductors 1 and row conductors 2 form a matrix with the perforations 3 being disposed at points of intersection of the rows and columns. Each row and column is separately controllable by an appropriate circuit (not shown). Each of the metallic tracks comprising the conductors 1 and 2 extend a distance into the perforations 3 of the carrier plate 4 in a limited manner such that the depth of metallization within the perforations 3 is controlled to generate a ring of exposed carrier material 4 between which substantially no electrical conductivity occurs. The separation of the metallized portions of the perforations 3 has a resistance of 100 megaohms or greater.

Figure 2:
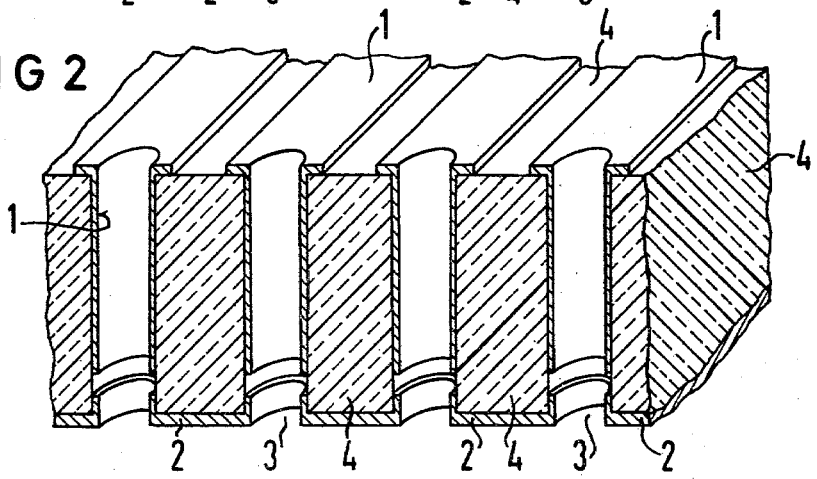
FIG. 2 is a perspective sectional view of a portion of a control plate having partially through-plated perforations wherein the through-plating extends unequal distances from opposite sides constructed in accordance with the principles of the present invention.

As shown in FIG. 1, the depth of metallization of the rows and conductors within the perforations 3 is substantially equal. A second embodiment is shown in FIG. 2 in which the column conductors 1 extend a substantially greater distance into the perforation 3 than do the row conductors 2 which extend only slightly into the perforations 3. Improved control can be achieved by this structure inasmuch as the column conductors 1 are disposed on the side of the carrier plate 4 closest to the anode within the gas discharge display device.

Figure 3:
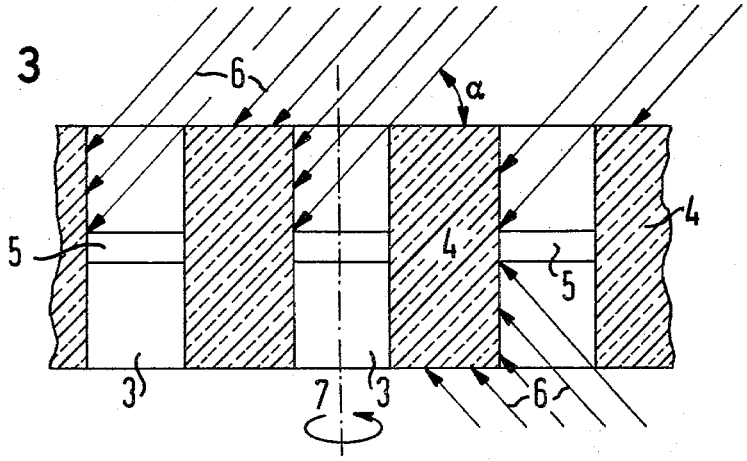
FIG. 3 is a side view in section of a method for manufacturing the structures of FIGS. 1 and 2 utilizing obliquely disposed developing radiation.

A first method for generating the structures of FIGS. 1 and 2 is schematically represented in FIG. 3 involving two-sided vaporization of a carrier plate 4 which may be approximately 1 mm thick and have dimensions of approximately 80 mm by 80 mm. An adhesive layer of aluminium oxide which is approximately 20 nm thick may be utilized in combination with a metallic layer of copper of approximately 300 nm in thickness with a substrate temperature of approximately 170° C. The angle of incidence of the vaporization beam 6 with respect to the carrier plate 4 is represented by the symbol $\alpha$ and is selected in such a manner that the interval 5 of the copper layers vaporized in the perforations 3 from both sides is approximately 0.1 mm. The vaporization may proceed from both sides simultaneously or may proceed successively utilizing a single source of radiation. The diameter of the perforations 3 is approximately 0.4 mm. During vaporization, the carrier 4 is rotated about an axis 7 which is perpendicular to the surfaces of the carrier 4 having the rows and columns thereon so that the radiation 6 extends into the sides of the perforation walls. The vaporization source is located at an interval above the carrier plate 4 which is greater than 5 times the diagonal of the carrier 4 so that a deviation of the angle $\alpha$ over the entire carrier surface is less than 9%.

After the vaporization, positive photoresist is sprayed on the surface of both sides of the carrier to form a layer having a thickness of approximately 5 micrometers which results in some photoresist entering the perforations 3, however, the photoresist layer within the perforations 3 will be of a lesser thickness.

This is followed by the application of a photolithographic mask having a line pattern at 50 micrometer intervals to each side of the carrier 4 with the patterns on the opposite sides being offset by 90°. Alignment of the mask with the perforations may be undertaken optically utilizing the perforations themselves or alternatively utilizing the edges of the carrier plate 4. The exposed tracks and the photoresist in the diffusely exposed perforations 3 are dissolved in a developer bath.

The now bared copper areas are galvanically strengthened with a three micrometer layer of copper and a one micrometer layer of nickel utilized as protection against corrosion of the copper. The remaining positive photoresist is subsequently removed by repeated exposure and developing bath applied to both sides of the carrier. At this point, a number of strengthened tracks are present which are still connected by the original thin metallized layer. This thin metallized layer is then etched away such as, for example, with a $FeCl_3$ solution so that only the strengthened rows and columns and the respective metallization within the perforations 3 remain, and the rows and columns are now separated electrically.

A final cleansing is carried out by any manner known to those skilled in the art such as ultrasonic cleaning in an acetone bath and/or application of acquiesce acid and basic solutions followed by a water bath.

Although the perforations 3 in the carrier plate 4 are shown in the figures as circular, carrier plates having eliptical, square or rectangular holes are also possible and may similarly be partially through-plated in accordance with the present invention. The angle $\alpha$ is calculated for those structures according to the largest diagonal of the hole.

In place of the sprayed positive photoresist layer, a photoresist foil may be utilized which may then be either positive or negative photoresist.

Figure 4:
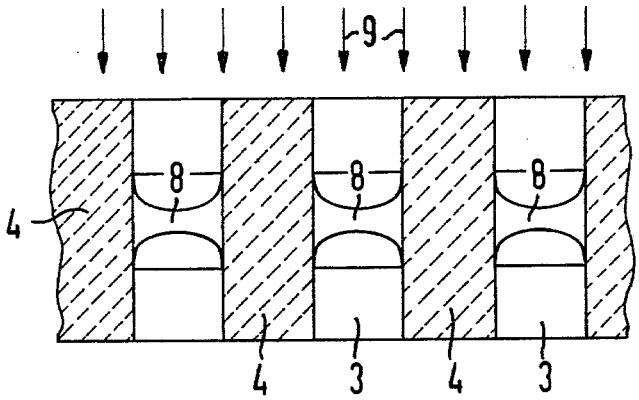
FIG. 4 is a side view in section of a method for manufacturing the structures of FIGS. 1 and 2 utilizing photoresist plugs within the perforations.

A further method for manufacturing the structures of FIGS. 1 and 2 is shown in FIG. 4 in which the carrier plate 4 is covered with a metallized copper layer over both of its opposite surfaces as well as entirely through the perforations 3. Such metallization may be undertaken by vaporization at large angles $\alpha$, with reference to FIG. 3, or by currentless precipitation processes as are well known in the art. The metallization layer thickness amounts to approximately 300 nm.

Very wet positive photoresist is sprayed on one side of the carrier plate 4 as indicated by the arrows 9. As a result of capillary forces the wet photoresist will collect in a central portion of each perforation 3 forming the convex collections of photoresist referenced at 8 in FIG. 4. The wet photoresist on the surface of the carrier plate 4 may be removed by a ductor while still liquid. After horizontal drying of the carrier plate 4, the plug structures 8 will be hardened in the holes 3. The thickness of the plugs 8 is at the center within the range of 100 to 300 micrometers. A five micrometer thickness of positive photoresist is then sprayed on both sides of the carrier plate 4.

The generation of the line structure on each side of the carrier plate 4 ensues in the manner described in connection with FIG. 3 utilizing photolithographic masking methods. The exposure times are selected short enough such that the plugs 8 are not entirely exposed and due to their geometrical configuration the centers of the plugs 8 will be exposed sufficiently to be removed while a ring of photoresist will remain around the walls of the perforations 3. The portion of the perforation wall covered by the photoresist is approximately 100 micrometers of a central area thereof while the remainder of the perforation walls are free of photoresist from the plugs to the opposite surfaces.

The conductive metallized tracks on the opposite surfaces of the carrier plate 4 are strengthened by galvanic deposition as already described in connection with FIG. 3. Subsequently, both surfaces of the carrier plate are intensely exposed and the remaining photoresist is removed from the conductive tracks and the portions of the perforation walls formerly covered by the ring.

Copper etching is then undertaken with a $FeCl_3$ solution so that the conductive tracks are electrically separated from one another and the non-strengthened metal rings in the holes 3 which were previously covered by the photoresist are also etched away so that the metallizations of the two opposite sides are electrically separated from one another. A final cleansing may then be undertaken in the same manner as described in connection with FIG. 3.

Figure 5:
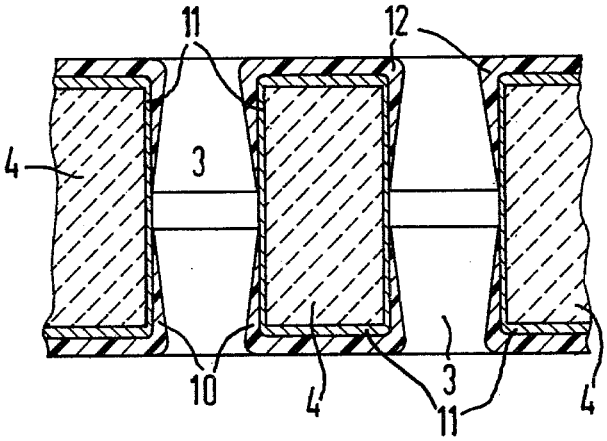
FIG. 5 is a side view in section of a method for manufacturing the structure FIGS. 1 and 2 utilizing positive and negative photoresist applied to opposite sides of the plate.

A further method of generating the structures of FIGS. 1 and 2 is shown in FIG. 5 in which a carrier plate 4 is first covered with a metallization layer 11 on both surfaces as well as completely through the perforations 3. The carrier 4 is sprayed on the column side with positive photoresist 10 and subsequently sprayed on the row side with negative photoresist 12. The photoresist layers have a thickness of approximately 5 micrometers. The dimensions correspond to those described in connection with FIG. 3. Two separate exposure masks are employed. During the first exposure, the column side is exposed so that the individual columns of holes and the tracks connecting them are exposed. This is followed by exposure of the row side of the carrier plate 4 with a mask so that the conductive tracks covering the hole rows and those areas around the holes 3 are not exposed.

After developing both photoresist systems, photoresist remains only as spacing lines between the conductive tracks and negative resist rings remain only in the holes 3 at the "row end" of each of the holes 3. The exposed copper tracks over the holes 3 and the metallization within each of the holes 3 which is interconnected to the column tracks are galvanically strengthened as described above. Removal of all photoresist residues and the original copper metallization layer is undertaken in the manner described above so that after such removal all that remains are the separated column and row tracks on the opposite sides and the metallization from the column side within the perforation 3 which is separated from the row metallization by the area formerly covered by the negative photoresist.

Other photolithographic techniques and materials may be utilized which are known in the art in place of the above-described techniques. For example, a photosensitive metallic paste may be utilized to generate the conductive tracks on the opposite sides of the carrier plate 4 in conjunction with, for example, silk screening. Depending upon the underpressure employed in this technique, it is possible to selectively control the depth of projection of the metallized layer into the holes. The subsequent exposure, removal and tempering processes can then be undertaken in any manner known to those skilled in the art.

Although other modifications and changes may be undertaken by those skilled in the art, it is the intention of the inventors to embody within the patent warranted hereon all changes and modifications as reasonably and properly come within the scope of their contribution to the art.

We claim as our invention:

1. A control plate for a gas discharge display device comprising:

a carrier plate consisting of electrically insulating material;

a plurality of spaced parallel metallic row conductor tracks disposed on a first side of said carrier plate;

a plurality of spaced parallel metallic conductor tracks disposed on a second opposite side of said carrier plate perpendicularly with respect to said row conductor tracks, said row and column conductor tracks in combination forming a matrix;

a plurality of control holes disposed in said carrier plate at points of intersection of said row and column conductor tracks in said matrix, said metallic row and column tracks respectively extending a distance into said control holes from opposite sides of said carrier plate and separated within said control holes by a gap of exposed insulating material of said carrier plate forming a ring of high resistance.

2. The control plate of claim 1 wherein said high resistance is greater than 100 megaohms.

3. The control plate of claim 1 wherein said metallic column and row conductor tracks extend a substantially equal depth into each of said control holes and wherein said ring of high resistance is centrally disposed within each control hole.

4. The control plate of claim 1 wherein said metallic track for said column conductor extends a substantially greater distance into each of said control holes than the metallic track of said row conductors and wherein said ring of high resistance is disposed nearer the surface of said carrier plate having said row conductor tracks thereon.

5. The control plate of claim 1 wherein said carrier plate is comprised of photosensitive glass having a thickness in the range of 0.3 to 2 mm.

6. The control plate of claim 1 wherein said carrier plate is comprised of ceramic and has a thickness in the range of 0.3 to 2 mm.

* * * * *